United States Patent [19]

Smith

[11] Patent Number: 4,939,328

[45] Date of Patent: Jul. 3, 1990

[54] QUIET SWITCHING APPARATUS AND METHOD OF OPERATION

[75] Inventor: Robert J. Smith, Farminton, Mich.

[73] Assignee: Judco Manufacturing, Incorporated, Harbor City, Calif.

[21] Appl. No.: 289,376

[22] Filed: Dec. 23, 1988

[51] Int. Cl.[5] ..... H01H 13/58

[52] U.S. Cl. ..... 200/526; 200/16 A

[58] Field of Search ..... 200/16 A, 16 B, 520, 200/521, 523, 526, 527, 528, 535, 303, 341, 342, 345

[56] References Cited

U.S. PATENT DOCUMENTS

| | | | |
|---|---|---|---|
| 3,204,067 | 8/1965 | Brown | 200/527 |
| 3,694,603 | 9/1977 | Congelliere et al. | 200/526 |
| 4,175,222 | 11/1979 | Buttner | 200/528 |
| 4,225,764 | 9/1980 | Buttner | 200/526 X |
| 4,288,670 | 9/1981 | Buttner | 200/16 A X |
| 4,308,440 | 12/1981 | Buttner | 200/535 |
| 4,317,015 | 2/1982 | Buttner et al. | 200/526 |
| 4,345,128 | 8/1982 | Buttner et al. | 200/16 A X |

*Primary Examiner*—J. R. Scott

*Attorney, Agent, or Firm*—Fulwider, Patton, Rieber, Lee & Utecht

[57] ABSTRACT

A miniature ratchet type electrical switch exhibiting a reduced audible noise level operation having a damping spring incorporated in a ratchet mechanism switch construction for reducing the forces otherwise exerted on the ratcheting mechanism by a main spring during the camming and seating operation of the components with the force exerted by the damping spring opposing the force exerted by the main spring, thereby reducing the noise associated with this function, and including a reprofiled tooth and cam configuration for preventing the jamming of the moving parts. Incorporation of these features in a ratchet mechanism type electrical switch in which the main spring completes the switch circuitry yields a reliable and aesthetically improved switch function with a high current carrying capacity. Switch constructions in both single-pole, double-throw and single-pole, single-throw versions are disclosed.

22 Claims, 7 Drawing Sheets

FIG. 3.
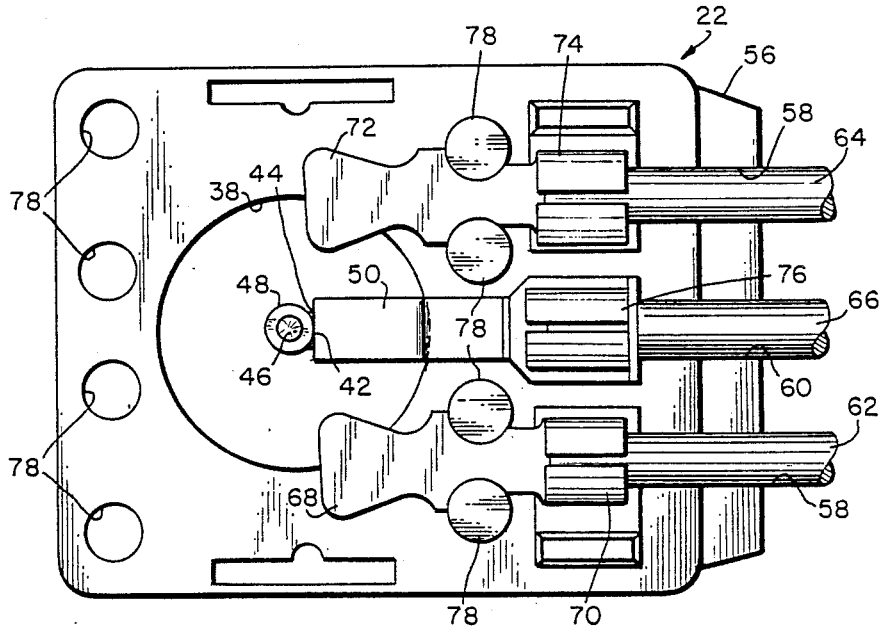
FIG. 4.
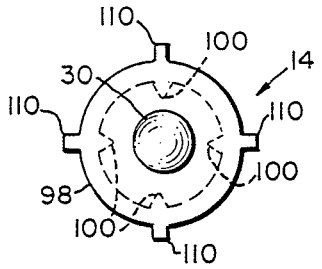
FIG. 5.
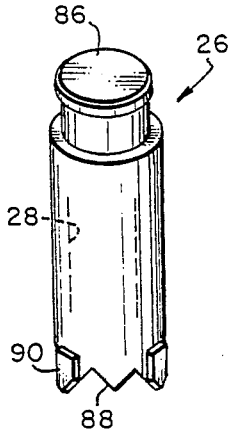
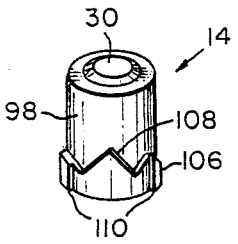
FIG. 6.
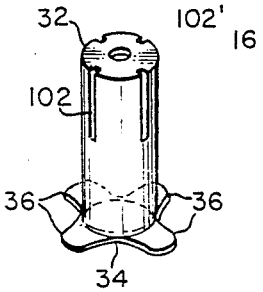
FIG. 7.

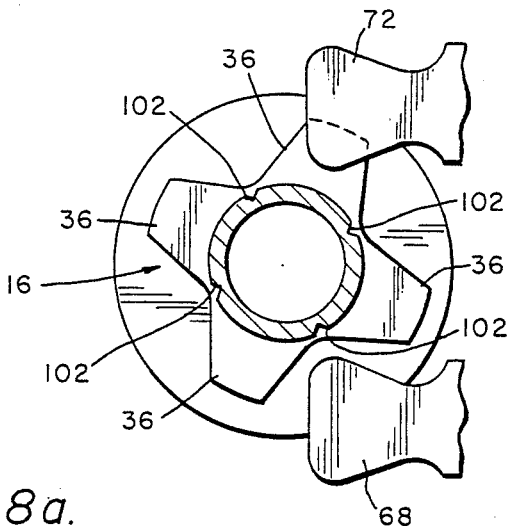
FIG. 8a.
FIG. 8b.
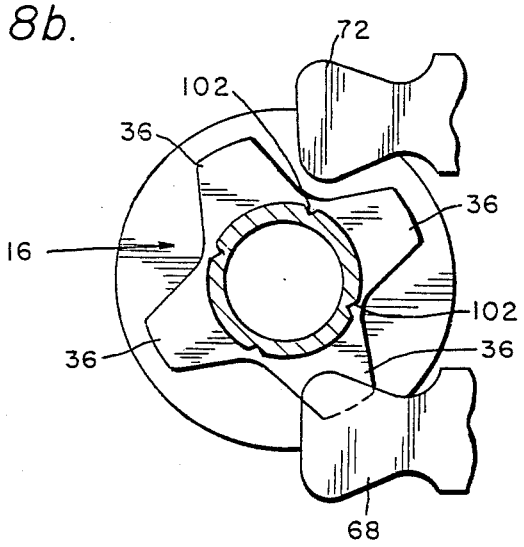

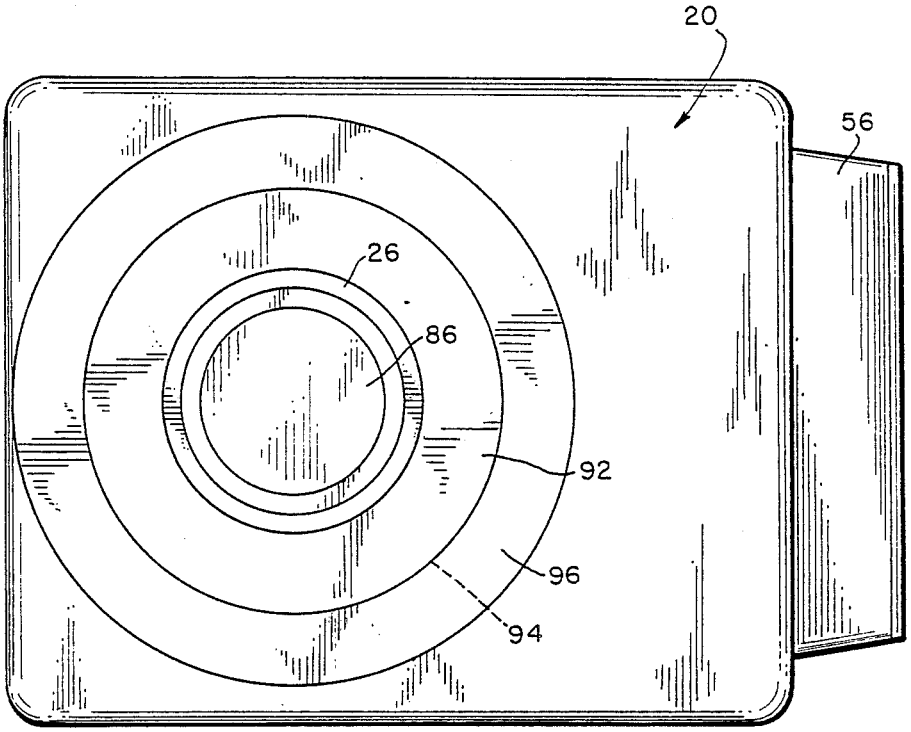
FIG. 9.
FIG. 10.
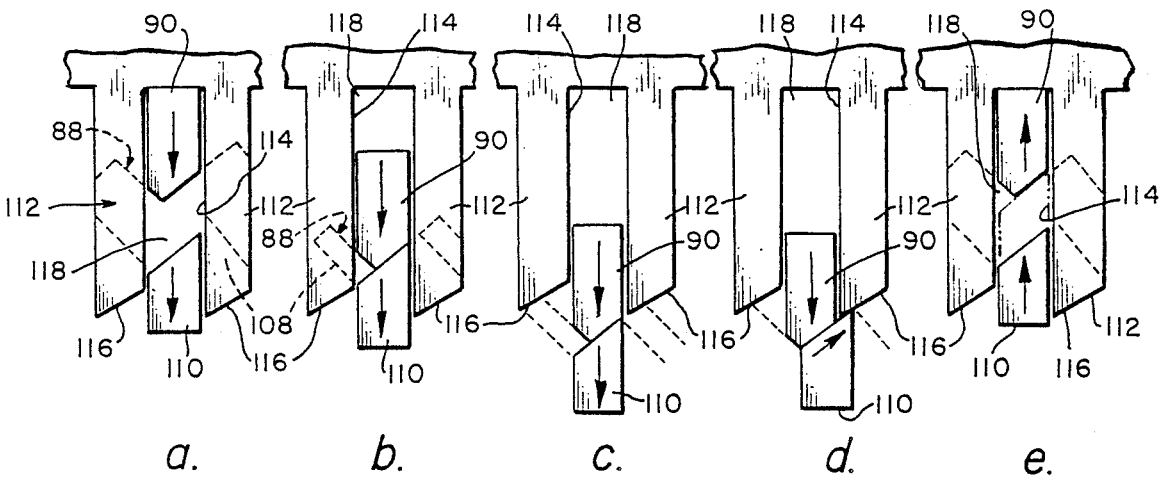

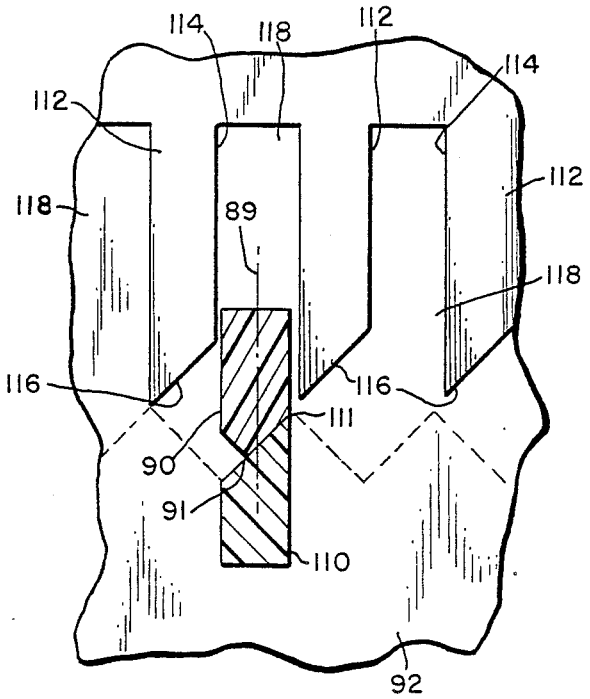
FIG. 11.
FIG. 13.
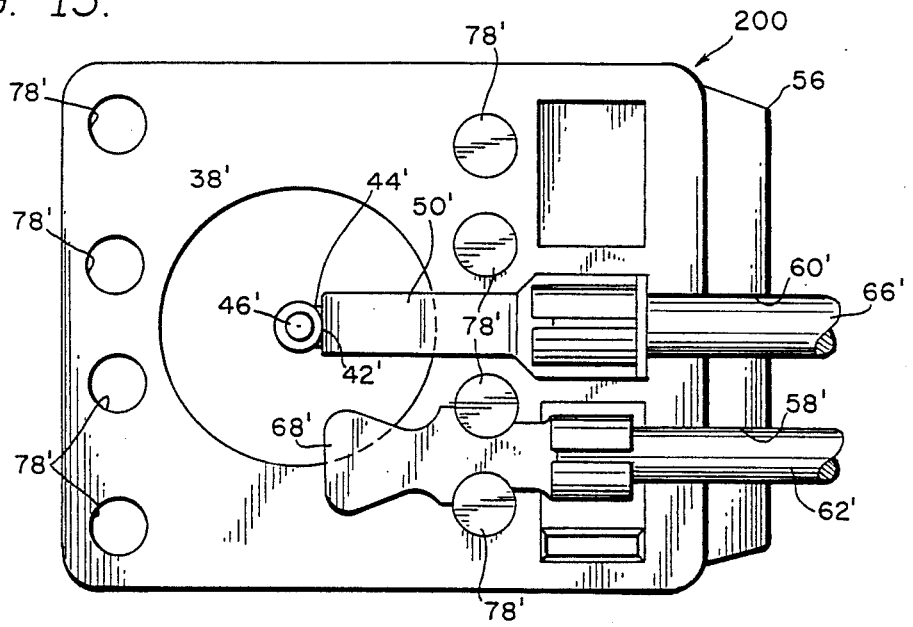

QUIET SWITCHING APPARATUS AND METHOD OF OPERATION

BACKGROUND OF THE INVENTION

1. Field of the Invention

This invention relates to miniature switches for use in electrical circuits, and more particularly, to miniature push button electrical switches that exhibit quiet operating characteristics for minimizing noise production.

2. Description of the Related Art

In the field of electrical switch design, audible noise often results from the operation of the switch mechanism and varies with the type of switch mechanism used. While some designs achieve noiseless operation (such as clamp type or mercury switches), most types of switches produce audible noise due to the mechanical construction. Efforts have been expended to quite down the operation of some of these designs. A reinforced or modified switch designed to accommodate a higher current carrying capacity generally produces higher levels of audible noise. An example of an application of an electrical switch that normally produces a high level of audible noise is a typical commercial or residential wall mounted light switch. Certain manufacturers have designed wall mounted light switches which produce a lower level, although as to an inaudible amount of noise, and such switches are available for use in the construction industry.

The decision whether to use a high audible noise switch or a low audible noise switch is subjective. A more relevant example exists in the electrical switches employed in the cabin of expensive motor cars. Some manufacturers prefer that the switches employed produce low audible noise levels to be consistent with the mood created by the luxury coachwork. Conversely, many European automobile manufacturers choose to employ a heavy duty electrical switch within the cabin which produces a high level of audible noise.

Electrical switches are also normally employed in consumer appliances. Because of electrical installation standards required by the National Electric Code, appliances are often designed with two layers of plastic insulation referred to as "double insulation". By employing double insulation in the manufacture of electrical appliances, the use of ground wire conductors may be dispensed with since the threat of electrical shock is reduced. The plastic construction of the appliance not only insulates the electrical circuit contained within the appliance, but also acts as a sounding board for the absorption of the audible noise produced by the electrical switch. Switch construction employed in electrical appliances normally produce high levels of audible noise.

In the past, the construction of a switch displaying quiet switching action has been accomplished in a small number of switch types. A first example of such a quiet switch-type is a "disc mechanism" switch which is available in manual or automatic designs. An example of the "disc mechanism" switch may be a rotating switch device having a plurality of contacts with each contact located at the end of an individual finger. The fingers may be connected to the central disc mechanism which is rotated on a periodic basis and which may be controlled by a computer program. The contacts located at the end of the fingers may pass through a narrow space which includes a stationary contact connected to electrical circuitry.

During the period of time that one of the plurality of fingers is located in the narrow space, the first finger contact and the stationary contact are in communication completing an electrical circuit. Upon manual or automatic operation, the disc mechanism may be rotated causing the contact located at the end of the first finger to break communication with the stationary contact located within the narrow space. Electrical communication with the next contact located at the end of the next finger rotated into position is then made with the stationary contact located in the narrow space.

A second type of quiet switch developed by designers in the past is the "heart and bail" switch. This type of switch is normally employed in telephone switchboards and is a spring-cam operated switch. The cam has the characteristic shape of a heart while the bale is a wire which limits the travel of the spring operated switch. The "heart and bail" portion of the switch is mechanical in nature and is not associated with the electrical switching portion Although the "disc mechanism" switch and the "heart and bail" switch are generally quiet switches, their application is limited, particularly with respect to the current carrying capacity.

A third type of quiet switch developed in the past is the "membrane switch". The membrane switch is also associated with telephone equipment and is of the type normally found on a telephone keyboard employed as a dialing switch. In dialing a telephone, the membrane switch is employed for transmitting intelligent information at signal levels in the microamp and milliamp range. As with the previous quiet switch designs, the membrane switch is also current limited restricting its usage.

A type of push button switch typically capable of accommodating relatively high electrical currents is one employing a ratchet mechanism. Depression of the plunger of such a switch causes an electrical switching member to alternately make and break the electrical contacts in the switch. The ratchet mechanism of such switches makes a distinctive "clicking" sound as the mechanism is operated and, as discussed above, the "clicking" sound can be undesirable for certain applications. Further, certain problems unique to ratchet mechanism type switches must be considered when incorporating means to quiet the operation. Because ratchet switches employ wire coil springs damage to the internal structure of the switching device can occur when the ratchet mechanism rotates in a direction opposite to the direction to which the spring is wound.

Still another problem unique to ratchet switches is that when the point of contact between the teeth of the switch plunger are directly aligned opposite to the teeth of the ratchet mechanism, the ratchet mechanism can misalign upon operation preventing positive engagement of the teeth and causing the ratchet not to rotate. The misalignment and failure to rotate causes the ratchet switch to remain in a single position. The end result is that the electrical contacts of the device are not switched.

Additionally, the current carrying capacity of such a switch must not be compromised in the effort to quiet the operation by perhaps reducing the contact separation during the open circuit position or reducing the contact engagement force during the closed circuit position. Thus, it is desirable that any methods used to quiet such switches do not impact the basic functions and advantages of the switch and its ability to carry the desired current.

Hence, those concerned with the development and use of quiet switches in the electrical construction field have long recognized the need for improved miniature switching systems which reduce the audible noise level during operation, have higher current carrying capacities while utilizing standard parts of the existing ratchet switch, are capable of switching multiple circuits, prevent misalignment of the ratchet teeth and misoperation of the switch, and which minimize wear thereby extending the life of the switch. The present invention fulfills all of these needs.

SUMMARY OF THE INVENTION

Briefly, and in general terms, the present invention provides a new and improved miniaturized quiet push button ratchet switch construction and method which substantially reduces the audible noise level of the push button switch during the ratcheting operation increasing the esthetic quality of the switch, and which significantly increases the current carrying capacity of quiet switches. Moreover, the ratchet switch construction of the present invention utilizes the standard parts of existing ratchet switches, retains the capability of switching multiple circuits, prevents misalignment of ratchet teeth and potential misoperation of the switch, and minimizes wear of the switching assembly thereby extending the service life of the switch.

Basically, the present invention is directed to an improved, miniature push button ratchet switch and method of operation for substantially reducing the audible noise level during the ratcheting operation of the switch and for increasing the current carrying capacity of quiet switches in general. This is accomplished by modifying the design of a known ratchet switch by adding a damping spring for providing a new quiet switch construction.

In accordance with a preferred embodiment of the invention, a known miniature ratchet switch which includes a main spring for operating the ratchet mechanism upon depression of a push button plunger, and which forms part of the electrical circuit is modified by adding a damping spring seated within the push button plunger. The damping spring is designed to dampen the audible noise created by the ratchet mechanism during the ratcheting and seating operation. Further, the development of the instant quiet switch provides an advance in the art by increasing the current carrying capacity of the prior known quiet switches.

In accordance with the improved method of the present invention, the quiet ratchet switch is connected into an electrical circuit in either a single-pole, double-throw or a single-pole, single-throw configuration so that the switch will be continuously connected, or in the alternative, alternately connected to an electrical circuit. Upon depression of the plunger, the ratchet mechanism is actuated resulting in the rotation of the ratchet mechanism and a contact cup which changes the position of the contact terminals resulting in modifications to the electrical connections. The damping spring exerts a force that opposes or counteracts a portion of the force exerted by the main spring on the ratchet mechanism during the ratcheting operation and therefore reduces the force imposed on the ratchet mechanism during operation. The force applied by the damping spring substantially lowers the audible noise level created during the ratcheting and seating operation. At the point of ratchet, the damping spring exerts a force that is selectively lower than the force exerted by the main spring to prevent interference with the electrical continuity between the contact cup and the contact terminals when the switch is in the closed position. Thus, the current carrying capacity of the switch is not compromised by the quiet switching modification.

The new and improved quiet ratchet switch and method of operation of the present invention substantially reduces the audible noise level of the miniaturized switch during the ratcheting operation, significantly increases the current carrying capacity over quiet switches of the past, utilizes the standard parts of existing ratchet switches, is capable of switching multiple circuits, prevents misoperation of the switch due to ratchet tooth misalignment, and minimizes wear of the switching assembly by incorporating hardened surfaces and by attention to coil spring orientation for extending the service life of the switch.

These and other features and advantages of the invention will become apparent from the following more detailed description, when taken in conjunction with the accompanying drawings, which illustrate, by way of example, the features of the invention.

BRIEF DESCRIPTION OF THE DRAWINGS

FIG. 3 is a planar view of a cover portion in accordance with the invention taken along line 3—3 of FIG. 1;

FIG. 4 is a bottom view of a ratchet mechanism in accordance with the invention of FIG. 1;

FIG. 5 is a perspective view of a push button plunger in accordance with the invention of FIG. 1;

FIG. 6 is a perspective view of the ratchet mechanism in accordance with the invention of FIG. 1;

FIG. 7 is a perspective view of a contact cup in accordance with the invention of FIG. 1;

FIGS. 8*a* and 8*b* are top planar views of the contact cup in accordance with the invention of FIG. 1;

FIG. 9 is a top planar view of the miniature quiet ratchet switch of FIG. 1;

FIGS. 10*a*–10*e* are fragmentary cross-sectional views of the miniature quiet ratchet switch taken substantially along the line 10—10 of FIG. 2;

FIG. 11 is an enlarged, fragmentary detail view illustrating the ratchet mechanism of the miniature quiet ratchet switch of FIG. 2;

FIG. 13 is a planar view of an alternative embodiment of a miniature quiet ratchet switch of the present invention.

DETAILED DESCRIPTION OF THE PREFERRED EMBODIMENT

Figure 1:
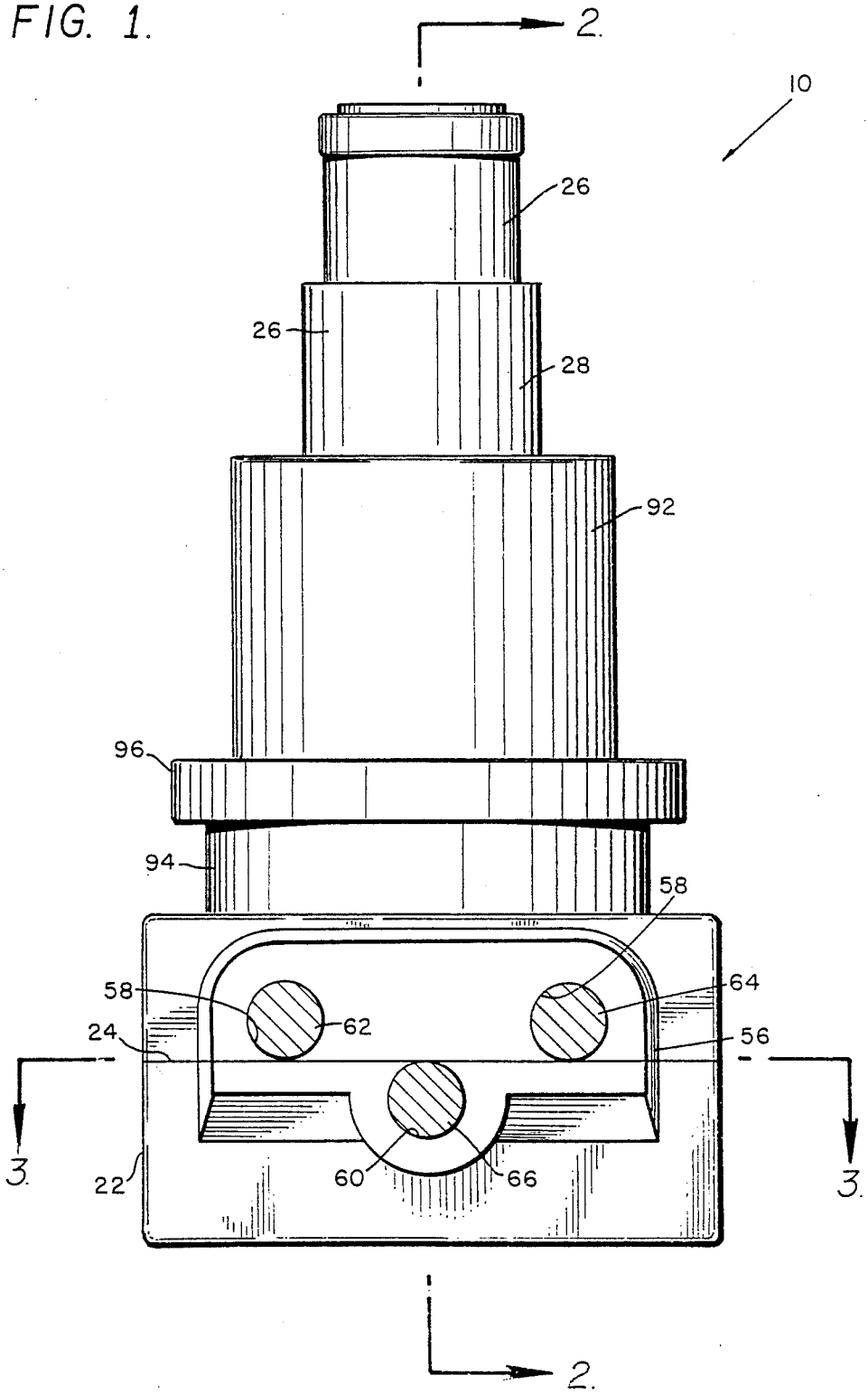
FIG. 1 is a frontal elevational view of a miniature quiet ratchet switch employing the novel features in accordance with the present invention.

As shown in the drawings, which are included for purposes of illustration, but not by way of limitation, the invention is embodied in a miniature quiet ratchet switch 10 of the type having a main spring 12 for operating a ratchet mechanism 14 and for rotating a contact cup 16 which alternately interconnects electrical contacts and further having a damping spring 18 fitted within the ratchet switch which counteracts a portion of the force exerted by the main spring 12 on the contact cup for reducing the audible noise level of the switch during the ratcheting operation.

In certain design situations, the choice as to whether to specify an electrical switch having a high or low audible noise level is a subjective one. The choice of electrical switches employed in the interior design of luxury automobiles is an excellent example. Certain manufacturers require that quieter switches be employed to accent the mood created by the luxury interior. European manufacturers tend to specify heavy duty electrical switches having high levels of audible noise. In an effort to satisfy both the esthetic value and the quality of heavy duty construction, some manufacturers tend to select electrical switches having a medium level of audible noise. Another example involves the design of electrical appliances in which the utilization of a quieter switch would be more esthetically pleasing. The double plastic insulated construction used in electrical applicances tends not to absorb the noise produced by the switch.

Several quiet-type switches have been designed and utilized in the past but have characteristically been employed in the telephone switching industry and typically have a low current carrying capacity. Examples of these types of switches include a "disc mechanism" switch and a "heart and bail" switch which are employed in low current carrying circuits and telephone switchboard applications. A third example is a "membrane switch" which is also employed in telephone switching equipment and particularly in dialing-type circuitry for transmitting small signal levels.

There is a need in the electrical industry for a miniaturized ratchet switch mechanism having quieter operating characteristics and relatively high current carrying capacity compared to such switches known in the past. Although ratchet mechanism type push button switches are typically capable of carrying higher currents than existing quiet switches, they produce noise during the switching operation that is unacceptable for some applications. There is a further need for a quieter ratchet switch employing a ratchet mechanism which rotates in a direction consistent with the wound direction of the internal springs to minimize excessive wear on the internal structure of the switch. Finally, a need exists for a quieter switch which offsets the teeth of the plunger with the teeth of the ratchet mechanism for preventing misalignment and misoperation of the switch.

In accordance with the present invention, the damping spring 18 fitted within the ratchet switch 10 and the main spring 12 mounted within the ratchet mechanism 14 cooperate for counteracting a portion of the force exerted by the main spring on the contact cup 16 for reducing the operating noise level, and to significantly increase the current carrying capacity of switches previously designed for quieter operation. Further, the ratchet mechanism rotates in a direction consistent with the wound direction of the main spring 12 for minimizing excessive wear on the internal structure of the switch, and is designed such that the meshing teeth of the operating mechanism are offset for preventing misalignment and misoperation of the switch.

Figure 2:
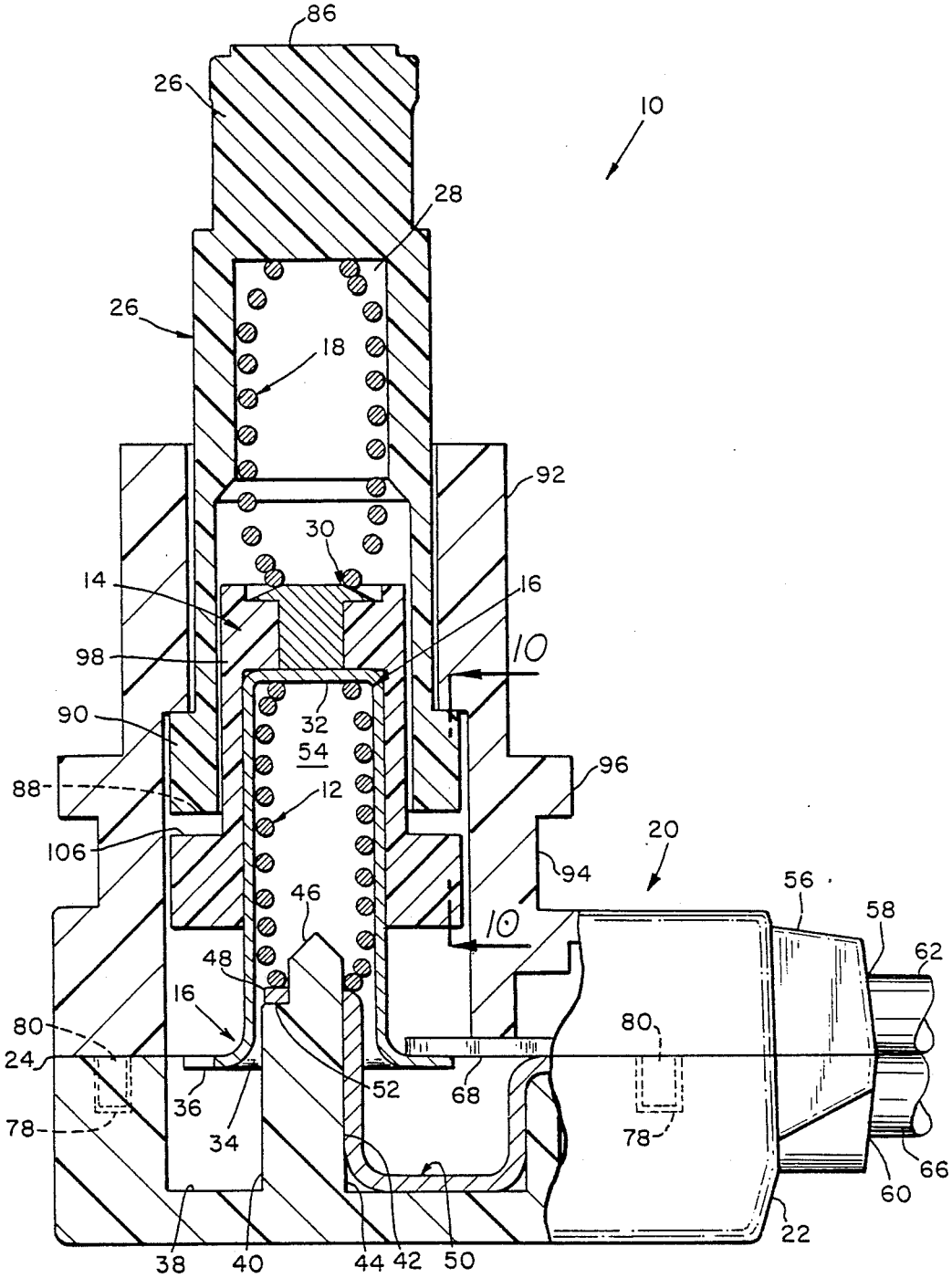
FIG. 2 is a cross-sectional view of the miniature quiet ratchet switch taken along the line 2—2 of FIG. 1.

The ratchet switch 10 is comprised of two major components, including a body portion 20 and a cover portion 22 as is shown in FIGS. 1 and 2. The body portion and the cover portion are physically joined at an interface 24, the location at which the switch may be disassembled. The upper section of the body portion 20 houses a push button plunger 26 and the ratchet mechanism 14. The plunger includes a hollow 28 which houses the damping spring 18 which is employed to reduce the noise level of the switch 10 during the ratcheting operation.

Mounted in the top end of the ratchet mechanism 14 is a hard steel surface 30, for example, such as a rivet head, which is employed as a thrust bearing seat for the damping spring 18. The contact cup 16 is metallic and is an integral part of the electrical conducting system of the switch 10. The contact cup generally takes the form of a right circular cylinder. A first end 32 is formed with a curved surface which abuts the bottom of the hard steel surface or rivet 30. A second end 34 of the contact cup 16 is fully open and includes a plurality of extension ears 36 each located in quadrature to one another. The cover portion 22 includes a centrally located well 38 which is employed to accommodate the electrical connections. A center post 40 rises from the well 38 of the cover portion 22. The center post is generally circular but has a portion of the circumference formed into an input terminal channel 42 having a pair of extension lips 44 located on each side of the channel 42 for securely retaining an electrical conductor mounted along the vertical side of the center post 40.

The circumference of the top of the center post 40 narrows forming a cone head 46 for penetrating a mounting hole of a ring portion 48 of a common input terminal 50. The ring portion 48 is seated on a ledge 52 formed at the interface between the center post 40 and the cone head 46 with the remainder of the common input terminal 50 being fashioned to sit within the input terminal channel 42 and along the centrally located well 38 of the cover portion 22. The main spring 12 is mounted within a hollow cavity 54 of the contact cup 16 between the first end 32 of the contact cup and the ring portion 48 of the common input terminal 50 mounted on the cone head 46 of the center post 40.

An electrical conductor input section 56 is located generally at the interface 24 as shown in FIG. 1 and in elevation in FIG. 2. The conductor input section 56 provides two symmetrically spaced openings 58 and a center opening 60 for circuiting electrical conductors into the ratchet switch 10. The symmetrically spaced openings 58 accommodate a first input electrical conductor 62 and a second input electrical conductor 64 while the center opening 60 accommodates a common input conductor 66 which is in electrical communication with the common input terminal 50.

The first input electrical conductor 62 is in electrical communication with a first input terminal 68 via a first terminal connector 70 while the second input electrical conductor 64 is in electrical communication with a second input terminal 72 via a second terminal connector 74. The first and second input terminals 68, 72 alternately make electrical contact with one of the plurality of extension ears 36 of the contact cup 16. Finally, the common input conductor 66 is in contact with the common input terminal 50 via a third terminal connector 76. The end of the common input conductor 66 external to the ratchet switch 10 is connected to an electrical source (not shown) while the ends of the first input electrical conductor 62 and the second input electrical conductor 64 which are external to the ratchet switch are each respectively connected to separate electrical loads (not shown).

The plunger 26 is shown as a cylindrical structure surrounding the top portion of the ratchet mechanism 14. Further, the ratchet mechanism is also shown as a cylindrical structure surrounding the contact cup 16 which is hollow and houses the main spring 12 which is a compression-type helical spring The plunger 26 includes a cylindrical hollow sleeve having a closed surface 86 on one end and a bottom circumference on an opposite end which includes a plurality of downwardly extending serrated teeth 88 and a plurality of radially extending protuberances 90. A single downwardly extending serrated tooth 88 is formed between each adjacent set of protuberances 90.

The plunger is spring loaded by the action of the damping spring 18 and the main spring 12 and projects from the top of a vertically extending port 92 formed in the body portion 20. The vertically extending port 92 includes a collar 94 and surrounding the collar located at the base of the vertically extending port is an integrally molded ring 96. The molded ring 96 is utilized in the structural mounting of the entire ratchet switch 10 to an appropriate surface (not shown). Immediately below the collar 94 is the electrical conductor input section 56 which includes the pair of symmetrically spaced openings 58 formed within the body portion 20 for accommodating the insertion of the first input electrical conductor 62 and the second input electrical conductor 64.

In the preferred embodiment illustrated, the body portion 20, the collar 94, the integrally molded ring 96 and the vertically extending port 92 represent an integrally molded unibody construction formed of insulating plastic. The body portion 20 is held securely to the cover portion 22 by a post and hole interference fit. A plurality of holes 78 are distributed about the cover portion 22 as is illustrated in FIG. 3. In addition, a plurality of posts 80 extending from the body portion are shown in phantom in FIG. 2 as seated within the plurality of holes 78 for securing the cover portion to the body portion The cover portion 22 includes the center opening 60 which is located symmetrically with respect to the symmetrically spaced openings 58 for accommodating the common input conductor 66.

The ratchet mechanism 14 includes a cylindrical sleeve 98 having a hollow interior for sliding over the contact cup 16 as shown in FIG. 4. Affixed to the top end of the ratchet sleeve 98 is the hard steel surface 30 employed for seating the damping spring 18. The interior of the ratchet sleeve 98 includes a plurality of vertical ribs 100 which are orthogonal to the inner wall of the ratchet sleeve 98 and arranged in a quadrature spaced relationship with one another. The ratchet cylindrical sleeve 98 slides over the contact cup 16 with the plurality of vertical ribs 100 being received by and sliding through a plurality of congruent vertical grooves 102 formed in the contact cup 16. The cylindrical sleeve 98 when mounted over the top of the contact cup 16 rests within the vertical grooves 102 at their bottom limit so that when the ratchet mechanism is caused to rotate, the contact cup 16 is carried along in the direction of rotation with the ratchet mechanism.

The contact cup 16 is metallic and is an integral part of the electrical conducting system as it serves to bridge the various electrical terminals of the switch 10. The contact cup has the general form of a right circular cylinder. The first end 32 is formed with a curved surface which abuts the bottom of the hard steel surface or rivet 30. The second end 34 of the contact cup is fully open and includes the plurality of extension ears 36 distributed in a quadrature spaced relationship to one another, but somewhat offset from the vertical ribs 100 of the cylindrical sleeve 98 and the vertical grooves 102 of the contact cup 16. The extension ears act as contacts for interconnecting with terminal 68 or terminal 72 with as much input terminal 50. The angular offset between the extension ears 36 and the vertical grooves 102 of the contact cup prevents both the input terminal 68 and the input terminal 72 from being simultaneously connected.

The ratchet mechanism 14 further includes a ledge 106 formed about the outer circumference of the cylindrical sleeve 98 and having a plurality of upwardly extending serrated teeth 108 and a plurality of protuberances 110 radially extending from the ledge 106 defining four quadrants. A single upwardly extending serrated tooth 108 is formed between each of the ratchet protuberances 110 and which are equally distributed about the circumference of the cylindrical sleeve 98. Elements associated with the ratchet mechanism 14 which include the cylindrical sleeve 98, the contact cup 16 and the plunger 26 are illustrated in detail in FIGS. 4 through 8(*b*) inclusive.

Insertion of the cylindrical structure of the ratchet mechanism 14 into the hollow 28 of the plunger 26 without inclusion of the damping spring 18, would cause the upwardly extending serrated teeth 108 of the ratchet mechanism to contact the downwardly extending serrated teeth 88 of the plunger 26, and the plurality of protuberances 110 of the ratchet mechanism would be offset from the plurality of protuberances 90 of the plunger. However, the construction of the ratchet switch 10 is distinguishable from similar constructions of the past in that the damping spring 18 causes the plunger 26 to be suspended substantially above the ratchet mechanism 14 so that the upwardly extending serrated teeth 108 of the ratchet sleeve 98 do not contact the downwardly extending serrated teeth 88 of the plunger without a force being applied to the closed surface 86 of the plunger. In the uncompressed position, the damping spring 18 in conjunction with the main spring 12 causes the plunger 26 to extend well above the top of the vertically extending port 92 of the body portion 20 as is illustrated in FIG. 2.

The vertically extending port 92 of the body portion 20 includes a plurality of vertical splines 112 molded into an interior wall 114 of the vertical port 92 as is illustrated in FIGS. 10*a* –10*e* and 11. The splines 112 are distributed about the inner circumference of the port 92 at regular intervals with each of the splines 112 extending to approximately three-quarters of the depths of the port. Each spline 112 has a terminal end 116 that is wedge-shaped configured to permit a complimentary-shaped object such as one of the protuberances 110 to slide across the edge of the terminal end 116 into a space 118 bounded by two parallel splines 112 and the interior wall 114 of the port 92.

The motion associated with a single cycle of actuation of the ratchet mechanism 14 including the plunger 26 and the cylindrical sleeve 98 in cooperation with the splines 112 will, now be described as is illustrated in FIGS. 10*a* –10*e*. The vertical splines 112 are separated by a portion of the interior wall 114 creating the space 118 which can accommodate a plunger protuberance 90 and a ratchet protuberance 110. Each of the protuberances 90 and 110 extend radially outward from the respective components to which they are attached and are slidably received in the space 118. Each of the splines 112 includes the terminal end 116 which is formed into a ratchet-shaped ramp at the lower extremity of the splines. As will hereinafter become apparent, it is essential that the location of the protuberances 110 relative to the teeth 108 is angularly offset when compared to the position of the protuberances 90 relative to the teeth 88. This feature is readily apparent when comparing FIGS. 5 and 6.

Due to the presence of the damping spring 18 between the plunger 26 and the ratchet mechanism 14, their respective protuberances 90 and 110 are normally held in a separated position as illustrated in FIG. 10(*a*). When the plunger 26 is depressed, the plunger protuberance 90 engages the ratchet protuberance 110 and forces it downward into the space 118 until it reaches the position illustrated in FIGS. 10(*b*) and 10(*c*). Due to the offset of the positions of the respective teeth relative to the respective protuberances, when both the protuberances 90 and the protuberances 110 reside between the splines 112, the teeth 88 and the teeth 108 do not completely mesh as is apparent in FIG. 10(*b*).

Once the protuberance 110 has been pushed beyond the end on the spline 112, the ratchet mechanism 14, driven by the force of the main spring 12, is free to rotate and close the gap between teeth 88 and 108 as is illustrated in FIGS. 10(*c*) and 10(*d*). At this point, the plunger 26 is fully depressed as is the main spring 12 located within the contact cup 16 between the first end 32 and the ledge 52 of the center post 40. Additionally, the damping spring 18 which is located in the hollow 28 of the plunger 26 is also in its most compressed state.

The maximum potential energy that is available in the compressed spring is now stored in the main spring 12 and in the damping spring 18. The force of the damping spring counters some of the force of the main spring 12 exerted upon the ratchet mechanism 14. Upon release, the push button plunger 26 begins to retract through the vertically extending port 92 driven by the energy stored in the main spring 12. Concurrently, the plunger protuberance 90 correspondingly retracts upward into the space 118.

As the plunger protuberance 90 recedes into the space 118, the ratchet mechanism, driven by the force of the main spring 12, attempts to follow. However, the camming action of the protuberance 110 on the terminal end 116 of the spline forces the protuberance 110 to rotate further into the adjacent space 118. As the ratchet protuberance 110 slides down the ramp-shaped terminal end 116 and up the adjacent space 118, the ratchet mechanism 14 is caused to rotate in the direction urged by the ramp-shaped terminal end.

Because the vertical grooves 102 of the contact cup 16 receive the vertical ribs 100 of the ratchet mechanism 14, the contact cup is carried with the rotating ratchet mechanism. As the contact cup is rotated, the plurality of extension ears 36 rotate therewith. Because the electrical conductors are circuited through the ratchet switch 10 via the common input conductor 66 and through either the first input electrical conductor 62 or the second input electrical conductor 64, the rotating contact cup interconnects either the first terminal 68 or the second terminal 72 with the common input terminal 50 as is illustrated in FIG. 3 and FIGS. 8*a* and 8*b*). Because the main spring 12 exerts a greater force than the damping spring 18, the first input terminal 68 or the second input terminal 72 maintains positive electrical contact with the extension ear 36 when in either closed circuit position.

After the ratchet protuberance 110 has travelled down the ramp-shaped terminal end 116 of the vertical spline 112, the next ratchet protuberance 110 located on the bottom circumference of the ratchet mechanism 14 enters the space 118 between the vertical splines and is driven upward adjacent to the interior wall 114 of the vertically extending port 92 by the kinetic energy stored in the main spring 12. Once the energy stored in the main spring is dissipated, the damping spring 18 opposes the residual energy in the main spring 12 and causes the plunger protuberance 90 to ride above the ratchet protuberance 110 completing a cycle of the ratchet mechanism 14.

Upon completion of the cycle, the extension ears 36 which act as rotating contacts have changed positions so that the electrical connections to the first input terminal 68 and the second input terminal 72 have been reversed as is illustrated in FIG. 8(*b*). Thus, the rotation of the ratchet mechanism 14 by a mere 45 degrees can result in a single pole, double-throw rotary switch action which does not require sliding contact between either of the input terminals 68, 72 or the rotating extension ears 36.

The damping spring 18 reduces the audible noise level of the ratchet mechanism 14 during the ratcheting and seating phases of the switching procedure. The damping spring is a compression-type helical spring comprised of piano wire, phosphor bronze, stainless steel, etc., and is mounted within the hollow 28 of the plunger 26. The design of the damping spring is such that when the ratchet switch 10 is electrically conductive, the damping spring 18 exerts a lower force than the main spring 12 to preserve electrical conductivity between the extension ears 36 of the contact cup and either the first input terminal 68 or the second input terminal 72. If the damping spring were to exert a greater force downward than the upward force exerted by the main spring, electrical contact would be lost as the extension ears 36 would be suspended below the input terminals 68 and 72. This situation is distinguishable from positions of the ratchet mechanisms during the ratcheting operation where sufficient force is exerted by the damping spring via depression of the plunger to compress the main spring thereby displacing the extension ears 36 downwardly and electrically disconnect the input terminals.

The interaction of the main spring 12 with the damping spring 18 will now be described in more detail. Generally speaking, as a deflective force is applied to a spring, an equal and opposite force is exerted by that spring accompanied by a commensurate amount of deflection. A coil-spring, when compressed, will exert such an equal and opposite force. Generally, the relationship between force and the amount of compression is a linear one. The amount of compression can be correlated with the working length of a spring wherein its free length minus its compression is equal to its working length:

$$\text{working length} - \text{free length-compression} \quad (1)$$

Figure 12:
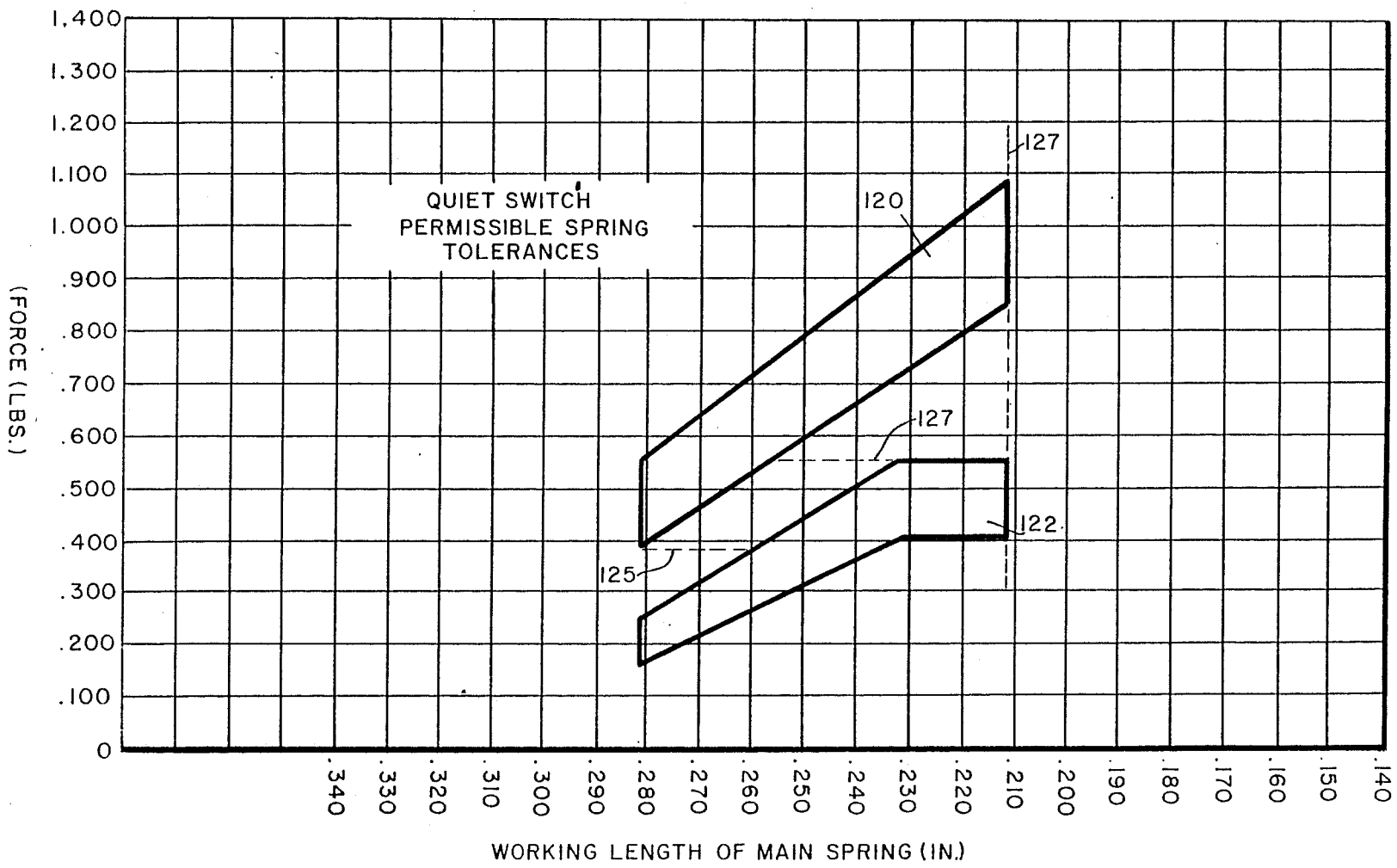
FIG. 12 is a graph illustrating the mechanical spring characteristics of the miniature quiet ratchet switch of FIG. 1.

FIG. 12 graphically represents the interrelationship of force and working length for the springs as used in an embodiment of the present invention. The vertical axis is calibrated in pounds of force while the horizontal axis is calibrated in inches of working length of the main spring 12. A first area 120 of the graph illustrates the permissible force tolerances of the main spring 12 as a function of its length while the second area 122 illustrates the permissible force tolerance of the damping spring 18, again as a function of the length of the main spring 12. The interrelationship between the working lengths of both springs is a function of the complex mechanical interaction of the ratchet teeth 108, plunger teeth 88, splines 112, spline terminal ends 116, ratchet sleeve protuberances 110 and plunger protuberances 90 throughout the depression, rotation and release process described above.

The graphic display of FIG. 12 illustrates the fact that for a given working length of the main spring 12, the force exerted by the damping spring 18 is always less than or equal to the force exerted by the main spring 12. This design requirement serves to ensure that contact between extension ears 36 of the contact cup 16 and the input terminals 68 and 72 is preserved while the switch is in the closed circuit position and that sufficient force differential is achieved with which the ratchet mechanism 14 is driven into its seated position during the ratchet operation.

As can be ascertained from the graph, the maximum working length the main spring 12 attains is 0.282 inches, its further extension being limited by the engagement of an extension ear 36 of the contact cup 16 with either terminal 68 or 72. Tolerance area 120 thereby suggests that the permissible force exerted by the main spring compressed length should be between 0.39 and 0.56 pounds. Not ascertainable from this graph is the fact that a compression of the main spring 12 to the 0.282 inches happens to correspond to a damping spring 18 working length of 0.295 inches While the actual working length of the damping spring may be incidental, the important parameter is however evident on the graph insofar as the damping spring 18 is to exert a countering force of between 0.15 to 0.25 pounds while the main spring 12 exerts its minimum range of force.

Upon depression of the plunger 26 the working length of the damping spring 18 is first compressed until a force equivalent to the force developed by the main spring 12 is achieved (indicated by dotted line 125). Further depression of the plunger 26 to cause both the main spring 12 and the damping spring 16 to compress the plunger 26 to engage the sleeve 98. At this point, indicated by dotted line 127) further depression of the plunger 26 directly decreases the working length of the main spring 12 until the point of ratchet 127 is attained This action is accomplished without effecting a further decrease in the damping spring working length and hence the force it exerts remains constant. Instead of simply snapping into the position illustrated in FIG. 10(*d*), the motion is damped by the presence of the damping spring 18. It is the net force, i.e., the difference between the main spring force and the damping spring force, that determines the dynamics of the ratchet mechanism 14 This causes the ratchet mechanism to accelerate at a lower rate and hence engage its seated position at a lower velocity. As a result, the audible noise level is significantly reduced. A similar interaction occurs when ratchet sleeve protuberance 110 slips into position 10(*e*) and again a significantly lower audible noise level is obtained.

The general principle applied here is as follows. The force generated by a spring is a function of its inherent spring rate, length, and amount of compression. In the case of a conventional ratchet type switch employing only one main spring (without a damping spring), these parameters can be selected to ensure that a desired force is applied on the ratchet mechanism 14 and hence by the contact cup 16 against the terminal 68 or 72 to ensure electrical contact while the switch is in the closed circuit position and the plunger is fully extended. However, upon depression of the plunger, an increasing amount of force will be applied to the ratchet mechanism 14 due to the linear relationship of force as a function of compression.

By the time the point of ratchet is achieved, a very high force will act upon the components to operate and seat the ratchet mechanism 14 into its rotated position and thereby create substantial audible noise By employing the two springs of the present invention, the net force acting upon the ratchet mechanism is of the essence and this net force is substantially less during the ratcheting operation. As a result, parameters selected to yield a particular net force to ensure electrical contact in the closed circuit position can serve to yield approximated the same net force at the point of ratchet. The reduced net force yields a reduced audible noise level when the ratchet mechanism rotates and seats into place.

Each of the main spring 12 and the damping spring 18 are small helically wound springs which normally have sharp edges at each end of the spring coil. The sharp edge of the damping spring, in particular, rubbing against the top of the plastic ratchet mechanism 14 would cause premature failure due to a machining action This machining action is caused by the ratchet mechanism 14 being rotated each time the plunger 26 is depressed To counter this problem, the hard steel surface 30 is provided in the top of the ratchet mechanism to alleviate this potential source of premature failure The hard steel surface 30 may be, for example, a rivet head or similar hard metal surface impervious to the sharp end of the spring As the contact cup 16 rotates, the hard steel surface acts to prevent the sharp edge of the damping spring coil from wearing through the top of the ratchet mechanism by friction, thus extending the service life of the ratchet witch 10.

An additional advantageous feature of the present invention includes attention to the winding direction of the damping spring 18 to thereby reduce the probability of premature failure of the ratchet switch 10. A damping spring wound in the same direction as the direction of rotation of the ratchet sleeve offers less resisting torque to the rotation during activation of the ratchet mechanism. When a helical structure is under compression, the spring has a tendency to rotate apart in the direction of the helix. The helical spring has a tendency to cause the ratchet sleeve 14 to rotate and if the direction of the winding of spring 18 is chosen such that ratchet sleeve 14 is urged by the spring in the same direction as the direction of rotation induced by the ratcheting mechanism, wear of the ratchet mechanism is reduced. Proper attention to this parameter thereby serves to extend the service life of the entire switch 10.

Another novel feature of the instant invention is included to prevent the misalignment of the plunger teeth 88 and ratchet teeth 108. Due to the inherent tolerances associated with the damping spring 18, the angular offset between the plunger teeth 88 and the ratchet teeth 108, and the possibly imprecise fit of the protuberances 90, 110 within the space 118, the possibility exists that the apex of the plunger protuberance 90 may engage the apex of the ratchet protuberance 110 and consequently jam the mechanism. In such an engagement, protuberance 110 will fail to slide across the cammed surface of the splined terminal end 116 when the plunger is depressed. In order to effectively reduce the possibility of that occurrence, the present invention calls for the slight repositioning of the protuberance 90 relative to the plunger teeth 88. As is illustrated in detail in FIG. 11, the position of the protuberance is such that its apex 91 is slightly offset from the center line 89 of the protuberance. This offset minimizes the possibility of the apex 91 of protuberance 90 engaging in the apex 111 of protuberance 110 and insures that the protuberance 110 will slide across the terminal ends 116 completing the ratcheting operation.

During the operation of the single pole, double throw switch 10 of the preferred embodiment, the extension ears 36 of the contact cup 16 alternate making electrical contact between the first input terminal 68 and the second input terminal 72. Assuming that the path of electrical current flow enters the switch from either of the input terminals and exits the switch through the common input conductor 66, the electrical circuitry path is as follows The electrical energy enters the switch through either of the input terminals 68, 72. One of the input terminals 68, 72 makes contact with one of the extension ears 36 of the contact cup 16 when the switch is in the closed circuit position Each of the extension ears is connected to the contact cup so that the flow of electrical energy through any one of the extension ears travels through the contact cup. The main spring 12 is in electrical communication with the contact cup and acts as a path for the electrical energy flow. The main spring is mounted on the ledge 52 of the cone-head 46 making electrical contact with the ring portion 48 of the common input terminal 50.

Therefore, the electrical energy flows through the main spring and exits the switch on the common input terminal 50 and the common input conductor 66. Upon operating the ratchet mechanism 14 as previously described, the contact cup 16 is carried with the ratchet mechanism so that the extension ears 36 are rotated breaking contact with the first input terminal 68 and making contact with the second input terminal 72, or vice-a-versa.

Each of the electrical conductors within the ratchet switch 10 are preferably comprised of beryllium copper or, in the alternative, phosphor bronze. Each of these metals will ensure good electrical conductivity along the conductors and terminals. The ratchet switch 10 is rated for both alternating current or direct current circuits with the voltage and amperage ratings depending upon the design specifications. Therefore, the ratchet switch 10 may be employed in many different switching applications in which reduced audible noise levels are desirable. Further advantageous features include the achievement of a higher current carrying capacity in a quiet switch construction of the same physical size and voltage rating as switches of the past. Additionally, by employing novel and inventive modifications, components employed in ratchet switches of the past may also be employed in the ratchet switch 10.

An alternative embodiment of the present invention illustrating a miniature quiet ratchet switch is identified by the general reference character 200 and illustrated in FIG. 13. In this instance, the alternative embodiment of the ratchet switch in FIG. 13 also is of the push button type similar to the ratchet switch of FIGS. 1 through 12. Structural parts of the ratchet switch of FIG. 13 which find substantial correpondence in structure and function to those parts of the ratchet switch of FIGS. 1 through 12 are designated with corresponding but primed reference numerals.

The ratchet switch 200 is a single pole, single throw miniature ratchet switch which differs from the ratchet switch 10 in that the second input electrical conductor 64, the second input terminal 72, and the second terminal connector 74 are each eliminated. Therefore, if it is assumed that the electrical energy enters the ratchet switch 200 via a first input electrical conductor 62' and exits the ratchet switch through a common input conductor 66', the switch is reduced to an "on-off" device As a push button plunger 26' is operated, a contact cup 16' is carried in rotation with a ratchet mechanism 14'. Because the contact cup rotates only forty-five degrees for each ratchet operation, two ratchet operations are required in order to rotate one of a plurality of extension ears 36 by ninety degrees Therefore, contact between a common input terminal 50' and a first input terminal 68' can be achieved only on every other ratcheting operation. The remainder of the operation of the ratchet switch 200 is identical to that of the ratchet switch 10 described in the preferred embodiment.

From the foregoing, it will be appreciated that the miniature push button ratchet switch of the present invention reduces the audible noise level of the ratcheting operation increasing the esthetic value of the switch, and that the current carrying capacity is increased over other quiet switches of the past having the same physical size and voltage rating. Further, the switch utilizes parts of known ratchet switches and is available in single pole, double throw or single pole, single throw configurations. Those skilled in the art will appreciate that, while a particular form of ratchet switch has been illustrated, the invention is adaptable to a variety of similar switch constructions that utilize mechanisms that are functionally similar. The switch employs heavy duty surfaces to minimize premature failure and includes a ratchet- plunger tooth offset to eliminate misoperation of the ratcheting mechanism.

While several particular forms of the invention have been illustrated and described, it will be apparent that various modifications can be made without departing from the spirit and scope of the invention. Accordingly, it is not intended that the invention be limited, except as by the appended claims.

What is claimed is:

1. A miniature switching apparatus comprising, in combination:

a housing;

contacting means mounted within said housing for communicating with a plurality of electrical circuits connected through said switching apparatus;

operating means mounted within said housing for rotating said contacting means;

an actuating element mounted within and projecting through said housing for rotatively driving said operating means;

a plurality of output terminals mounted within said housing, one of said output terminals alternately connecting a first of said electrical circuits to said contacting means while a second of said output terminals alternately connecting a second of said electrical circuits to said contacting means;

a common input terminal mounted within said housing, said input terminal in electrical communication with said contacting means for alternately energizing said first and second electrical circuits;

biasing means mounted within said contacting means for biasing said actuating element and for providing electrical continuity between said input terminal and said contacting means; and damping means mounted within said actuating element for reducing audible noise produced by said switching apparatus.

2. The miniature switching apparatus of claim 1 wherein said housing comprises a top body portion.

3. The miniature switching apparatus of claim 1 wherein said housing comprises a bottom cover portion.

4. The miniature switching apparatus of claim 1 wherein said actuating element comprises a push button plunger.

5. The miniature switching apparatus of claim 1 wherein said operating means comprises a ratchet mechanism.

6. The miniature switching apparatus of claim 5 wherein said ratchet mechanism is cylindrical in shape and fits within a cylindrical opening of said actuating element.

7. The miniature switching apparatus of claim 1 wherein said contacting means comprises a metallic contact cup including a flared portion at one end having a plurality of tabs for making electrical contact with one of said plurality of output terminals.

8. The miniature switching apparatus of claim 1 wherein an electrical conduction path is created between said contacting means, said biasing means, said common input terminal and one of said plurality of output terminals.

9. The miniature switching apparatus of claim 1 wherein said biasing means comprises a biasing spring mounted between a center post of said housing and said contacting means.

10. The miniature switching apparatus of claim 1 wherein said housing is comprised of a top body portion securely mounted to a bottom cover portion by a post and hole interference fit.

11. The miniature switching apparatus of claim 1 wherein said switching apparatus is designed for operation with alternating current voltage.

12. The miniature switching apparatus of claim 1 wherein said switching apparatus is designed for operation with direct current voltage.

13. The miniature switching apparatus of claim 1 wherein said damping means is a damping spring mounted in a hollow space between a closed surface of said actuating element and a hard surface of said operating means.

14. The miniature switching apparatus of claim 13 wherein said hard surface of said operating means comprises a rivet head.

15. The miniature switching apparatus of claim 1 wherein said damping means selectively exerts a force against said biasing means which is less than the force exerted by said biasing means when one of said output terminals communicates with said contacting means for ensuring a continuous electrical connection.

16. A miniature switching apparatus comprising, in combination:

a housing;

a contact cup mounted within said housing for communicating with a plurality of electrical circuits connected through said switching apparatus;

a ratchet mechanism mounted within said housing for rotating said contact cup;

a push button plunger mounted within and projecting through said housing for rotatively driving said ratchet mechanism;

a plurality of output terminals mounted within said housing, one of said output terminals alternately connecting a first of said electrical circuits to said contact cup while a second of said output terminals alternately connecting a second of said electrical circuits to said contact cup;

a common input terminal mounted within said housing, said input terminal in electrical communication with said contact cup for alternately energizing said first and second electrical circuits;

a biasing spring mounted within said contact cup for biasing said plunger and for providing electrical continuity between said input terminal and said contact cup; and a damping spring mounted within said plunger for reducing audible noise produced by said switching apparatus.

17. The miniature electrical switch of claim 16 wherein said contact cup includes a plurality of vertical grooves for receiving a plurality of vertical ribs mounted on an inner surface of said ratchet mechanism, said ribs being congruent with said grooves.

18. The miniature electrical switch of claim 17 wherein said contact cup is driven in a rotational path with said ratchet mechanism when said vertical ribs are mounted within said vertical grooves.

19. The miniature electrical switch of claim 16 wherein said damping spring is mounted between a closed surface of said plunger and a hard surface of said ratchet mechanism with said damping spring wound in a direction consistent with the rotation of said ratchet mechanism for minimizing wear to said miniature electrical switch.

20. The miniature electrical switch of claim 16 wherein a plurality of radially extending protuberances of said ratchet mechanism are offset from a plurality of radially extending protuberances of said plunger for preventing misoperation of said electrical switch when said plunger is depressed.

21. A miniature switching apparatus comprising, in combination:

a housing;

a contact cup mounted within said housing for communicating with an electrical circuit connected through said switching apparatus;

a ratchet mechanism mounted within said housing for rotating said contact cup;

a push button plunger mounted within and projecting through said housing for rotatively driving said ratchet mechanism;

an output terminal mounted within said housing, for alternately connecting said electrical circuit to said contact cup;

an input terminal mounted within said housing, said input terminal in electrical communication with said contact cup for alternately energizing said electrical circuit;

a biasing spring mounted within said contact cup for biasing said plunger and for providing electrical continuity between said input terminal and said contact cup; and a damping spring mounted within said plunger for reducing audible noise produced by said switching apparatus.

22. A method for switching an electrical circuit, said method comprising the steps of:

providing a housing;

communicating with an electrical circuit connected through said switching apparatus by providing a contact cup mounted within said housing;

mounting a ratchet mechanism within said housing for rotating said contact cup;

mounting a push button plunger within and projecting through said housing for rotatively driving said ratchet mechanism;

providing an output terminal within said housing for connecting said electrical circuit to said contact cup;

mounting an input terminal within said housing in electrical communication with said contact cup for energizing said electrical circuit;

positioning a biasing spring within said contact cup for biasing said plunger and for providing electrical continuity between said input terminal and said contact cup; and positioning a damping spring within said plunger for reducing audible noise produced by said switching apparatus.

* * * * *